US007036967B2

(12) United States Patent
Morishita et al.

(10) Patent No.: US 7,036,967 B2
(45) Date of Patent: May 2, 2006

(54) VEHICLE LAMP

(75) Inventors: Hisaya Morishita, Isehara (JP); Masafumi Kobayashi, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 123 days.

(21) Appl. No.: 10/739,535

(22) Filed: Dec. 19, 2003

(65) Prior Publication Data

US 2004/0179371 A1 Sep. 16, 2004

(30) Foreign Application Priority Data

Dec. 24, 2002 (JP) ..... 2002-372948
Dec. 24, 2002 (JP) ..... 2002-372949

(51) Int. Cl.
*F21V 7/00* (2006.01)

(52) U.S. Cl. ..... 362/517; 362/518; 362/298; 362/301

(58) Field of Classification Search ..... 362/517, 362/518, 543, 544, 545, 211, 297, 298, 300, 362/302, 303, 304, 305, 346
See application file for complete search history.

(56) References Cited

U.S. PATENT DOCUMENTS 3,443,086 A * 5/1969 Rikis ..... 362/303
4,587,601 A * 5/1986 Collins ..... 362/235
5,574,328 A 11/1996 Okuchi
5,582,480 A * 12/1996 Zwick et al. ..... 362/298
5,618,102 A * 4/1997 Ferrell ..... 362/516
6,641,293 B1 * 11/2003 Kumar et al. ..... 362/539

FOREIGN PATENT DOCUMENTS

| | | |
|---|---|---|
| FR | 708.577 | 7/1931 |
| FR | 2 626 347 A1 | 7/1989 |
| GB | 379568 | 9/1932 |
| JP | 2000-173313 A | 6/2000 |
| JP | 2002-109916 A | 4/2002 |

* cited by examiner

*Primary Examiner*—Thomas M. Sember
(74) *Attorney, Agent, or Firm*—Foley & Lardner LLP

(57) ABSTRACT

A reflector of a vehicle lamp includes a main reflector, a first sub-reflector, a second sub-reflector, and a relief portion. The main reflector includes a main reflection surface that reflects light from a light source in a forward direction. The first sub-reflector includes a first sub-reflection surface that reflects the light toward the second sub-reflector. The second sub-reflector includes a second sub-reflection surface that reflects the light reflected from the first sub-reflection surface in the forward direction. The second sub-reflector is arranged closer to the center axis than the main reflector, and the first sub-reflector is arranged farther from a center axis of the light than the main reflector, inclined inward via the relief portion, so that the light reflected from the main reflection surface is not blocked.

7 Claims, 14 Drawing Sheets

VEHICLE LAMP

CROSS-REFERENCE TO RELATED APPLICATIONS

The present document incorporates by reference the entire contents of Japanese priority documents, 2002-372948 filed in Japan on Dec. 24, 2002 and 2002-372949 filed in Japan on Dec. 24, 2002.

BACKGROUND OF THE INVENTION

1) Field of the Invention

The present invention relates to a vehicle lamp, and more particularly, to a vehicle lamp that effectively uses light irradiated from a light source to improve irradiation performance even if there is a dimensional limitation.

2) Description of the Related Art

A vehicle lamp is described in Japanese Patent Application Laid-Open No. 2000-173313. In this vehicle lamp, a reflector is divided into two regions to reduce the size of the reflector; a main reflector and a sub-reflector. The main reflector reflects a part of the light from the light source directly in a forward direction. The sub-reflector reflects the remaining portion of the light from the light source to the main reflector, and the main reflector reflects the light reflected from the sub-reflector in the forward direction.

However, the vehicle lamp has a drawback that a part of the reflection light reflected by the main reflector may be blocked by the sub-reflector. Furthermore, a part of the reflected light from the sub-reflector may also be blocked by the light source. Therefore, the vehicle lamp may not use the light irradiated from the light source efficiently to irradiate the forward direction.

SUMMARY OF THE INVENTION

It is an object of the present invention to solve at least the problems in the conventional technology.

The vehicle lamp according to one aspect of the present invention includes a light source that emits light and a reflector that reflects the light. The reflector includes a main reflector, a first sub-reflector, a second sub-reflector, and a relief portion, formed in one. The main reflector includes a main reflection surface that reflects one portion of the light in a forward direction. The first sub-reflector includes a first sub-reflection surface that reflects other portion of the light to the second sub-reflector without letting the other portion pass through the light source. The second sub-reflector includes a second sub-reflection surface that reflects the other portion reflected from the first sub-reflection surface in the forward direction. The second sub-reflector is arranged closer to an optical axis of the light than the main reflector is. The first sub-reflector is arranged farther from the optical axis than the main reflector is, inclined inward via the relief portion, so that the one portion reflected from the main reflection surface is not blocked.

The vehicle lamp according to another aspect of the present invention includes a light source that emits light and a reflector that reflects the light. The reflector includes a main reflector and a first sub-reflector, formed in one, and a second sub-reflector separated from the main reflector and the first sub-reflector. The main reflector includes a main reflection surface that reflects one portion of the light in a forward direction. The first sub-reflector includes a first sub-reflection surface that reflects other portion of the light to the second sub-reflector without letting the other portion pass through the light source. The second sub-reflector includes a second sub-reflection surface that reflects the other portion reflected from the first sub-reflection surface in the forward direction. The first sub-reflector is arranged closer to an optical axis of the light than the main reflector is, inclined inward via the relief portion, so that the one portion reflected from the main reflection surface is not blocked. The second sub-reflector is arranged ahead of the light source, so that the one portion reflected from the main reflection surface is not blocked.

The other objects, features and advantages of the present invention are specifically set forth in or will become apparent from the following detailed descriptions of the invention when read in conjunction with the accompanying drawings.

DETAILED DESCRIPTION

Exemplary embodiments of a vehicle lamp according to the present invention are explained in detail with reference to the accompanying drawings. However, the present invention is not limited by those embodiments. The constituents in the embodiments include constituents that can be replaced or easily presumed by those skilled in the art, or substantially the same one. The light source for the vehicle lamp includes a tungsten halogen lamp, an incandescent lamp, and a discharge lamp, but the tungsten halogen lamp will be explained in the embodiments. In the explanation below, a direction of irradiation of the vehicle lamp is designated as forward, and a direction of the base of the lamp is designated as rearward, as in the instance when the vehicle lamp of the present invention is used for a vehicle headlamp. In the next three embodiments of the present invention, light-emitting units 7 and 7*a* built in a lamp 6 as the light source in the vehicle lamp, are explained as being formed by dots for the convenience sake, though these have actually a predetermined size.

Figure 1:
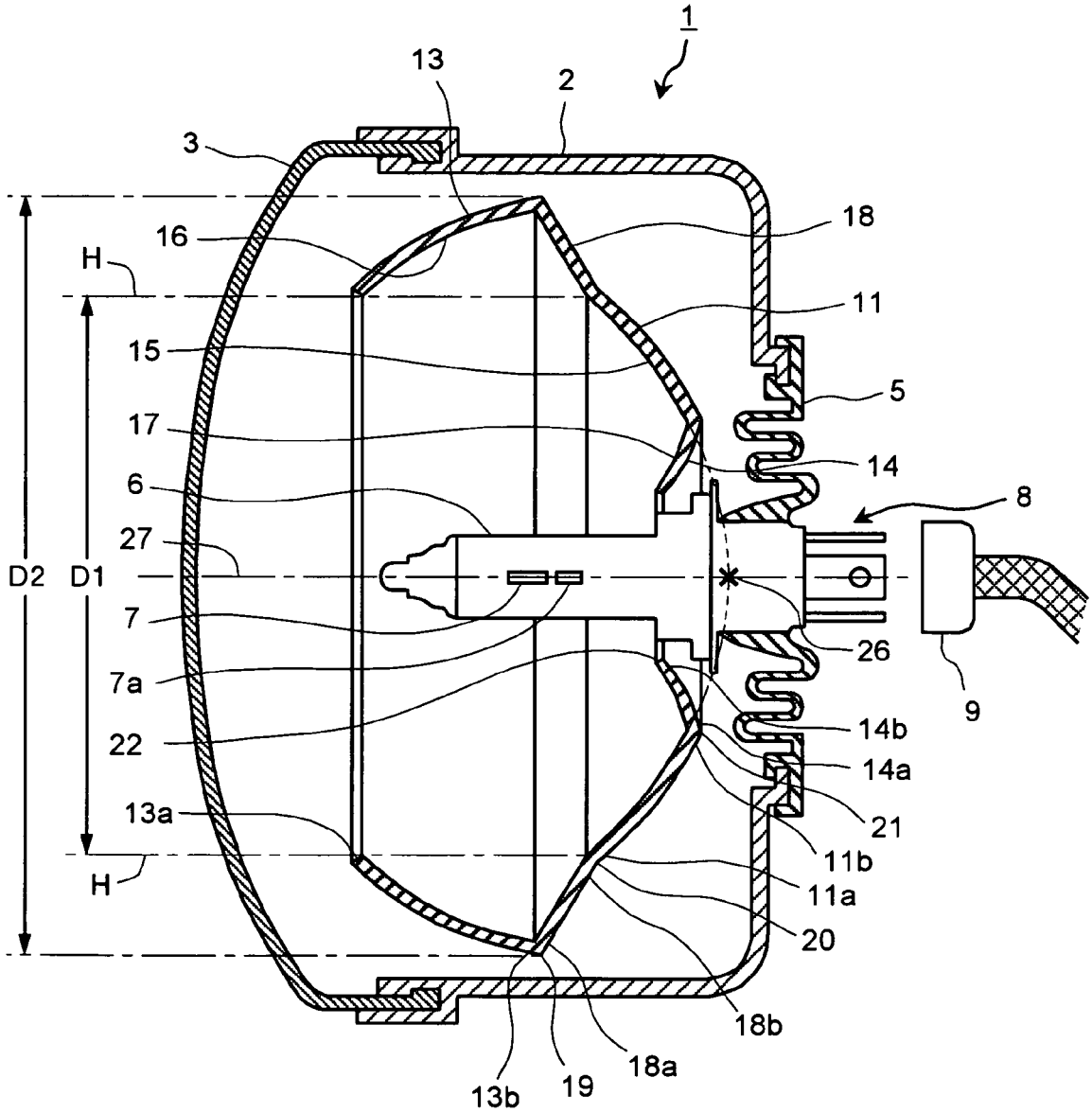
FIG. 1 is a partial cross section of a vehicle lamp according to a first embodiment of the present invention.
Figure 2:
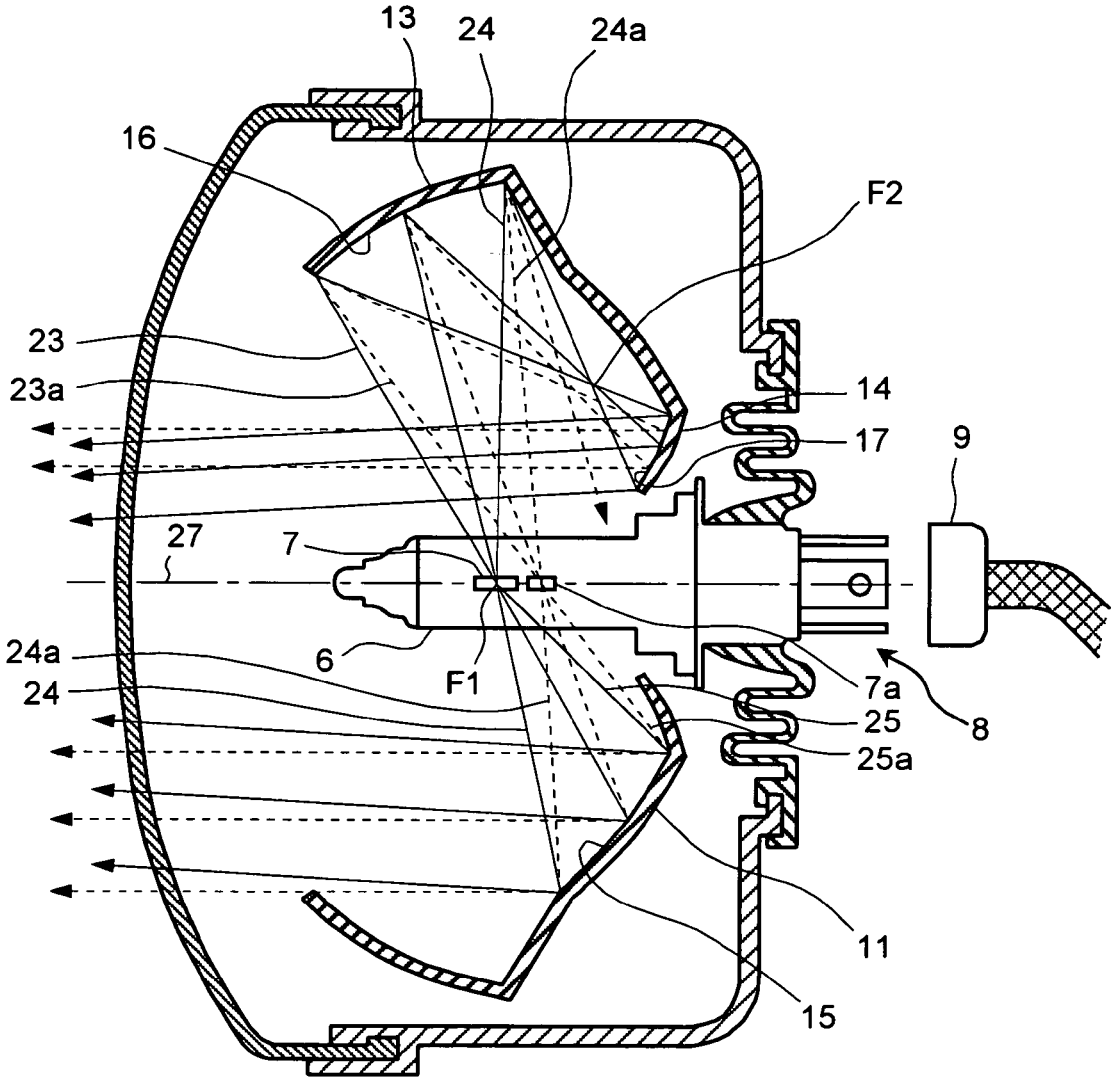
FIG. 2 depicts a reflection path of irradiation light from the vehicle lamp according to the first embodiment.
Figure 3:
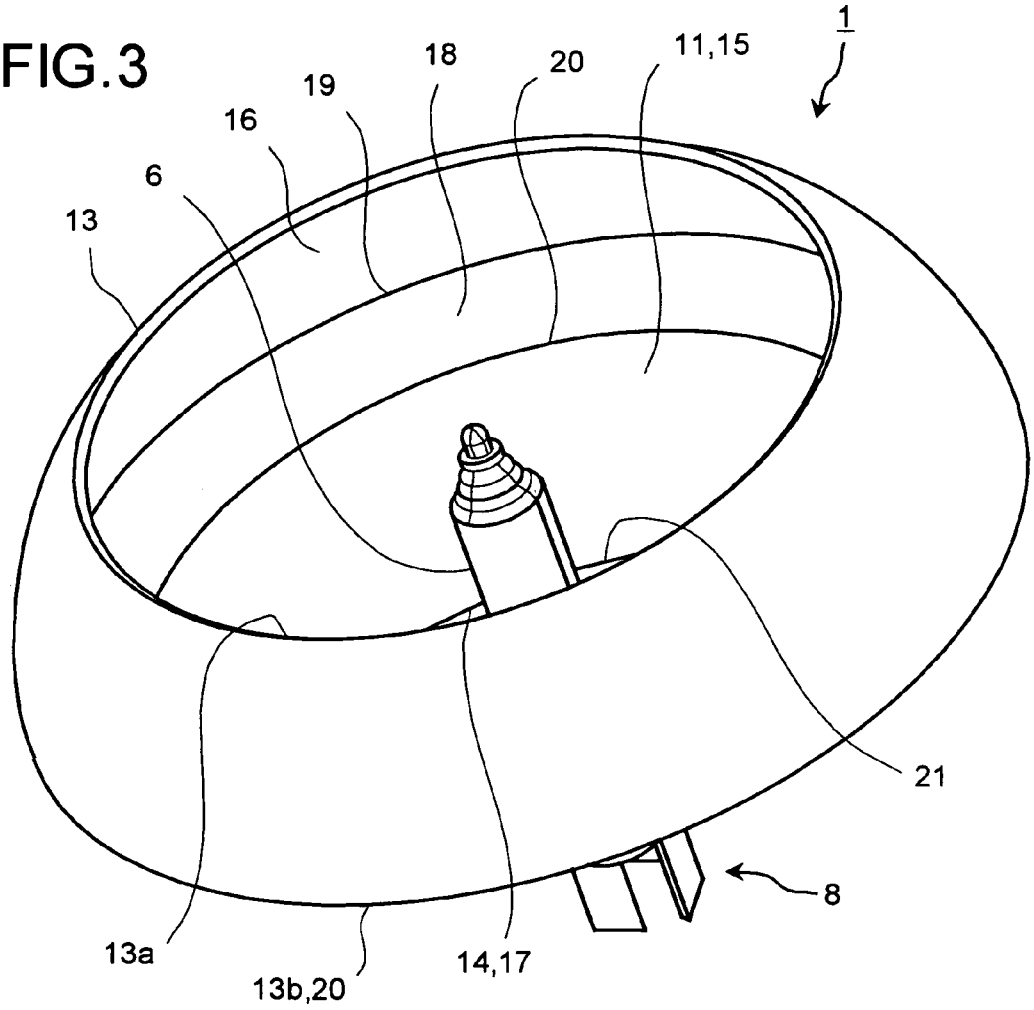
FIG. 3 is a schematic diagram for illustrating main parts of the vehicle lamp according to the first embodiment.
Figure 4:
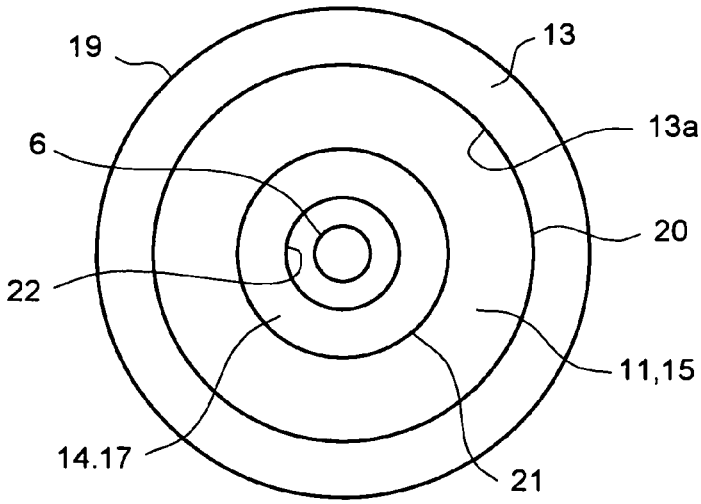
FIG. 4 is a front view of a reflector and a light source of the vehicle lamp according to the first embodiment.
Figure 5:
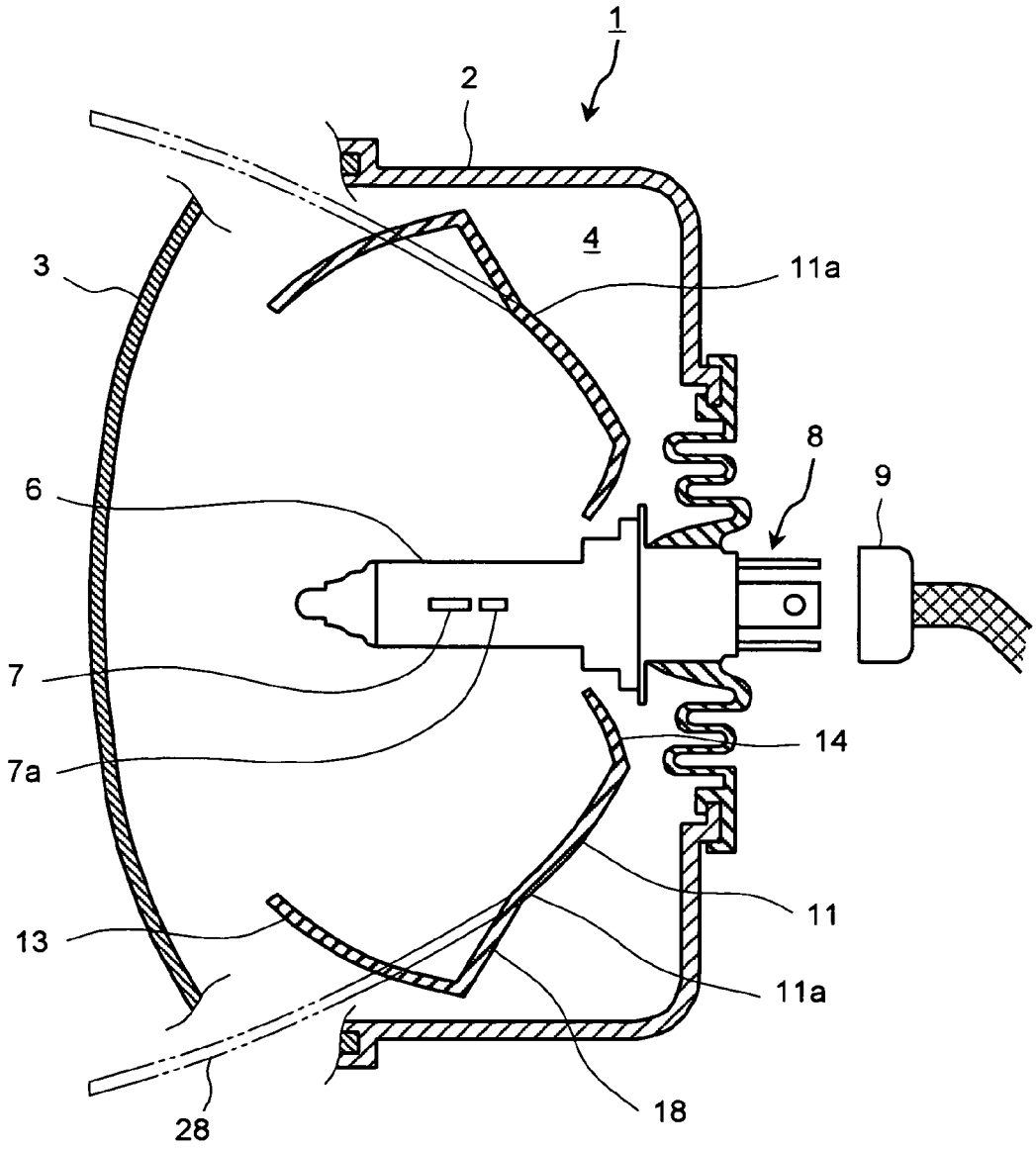
FIG. 5 is a diagram for comparing a shape of the reflector of the vehicle lamp according to the first embodiment with that of a conventional reflector.

FIGS. 1 to 5 depict a vehicle lamp according to a first embodiment of the present invention. In the vehicle lamp 1 shown in this figure, a lamp chamber 4 is formed by a lamp housing 2 and a lamp lens 3. A lamp 6 is arranged in the lamp chamber 4 as a light source for the vehicle lamp 1. The lamp 6 is fixed to the lamp housing 2 via a rubber cap 5.

Two filaments that emit light by applying an electric current are provided inside the lamp 6, as the light-emitting unit 7 for passing by and the light-emitting unit 7*a* for driving. The light-emitting unit 7*a* is provided behind the light-emitting unit 7. The light-emitting unit 7 is provided for passing by at the time of driving the vehicle, and the tight-emitting unit 7*a* is provided for driving the vehicle. A reflector is arranged in the lamp chamber 4. The reflector is integrally formed of a first sub-reflector 13, a relief portion 18, a main reflector 11, and a sub-reflector 14, in the order of from outside to inside.

A main reflection surface 15 is provided on the front face of the main reflector 11, a first sub-reflection surface 16 on the face facing the inside of the first sub-reflector 13, and a second sub-reflection surface 17 on the front face of the second sub-reflector 14, respectively. It is assumed that a point located near the light-emitting unit 7 is a first focal point F1, a point located at a predetermined position shifted from the light-emitting unit 7 in the lateral and back and forth directions is a second focal point F2, and a straight line passing through the first focal point F1 in the back and forth direction is designated as a centerline 27.

The main reflection surface 15 has a main reflector apex 26, being a virtual apex, on the centerline 27, designating the first focal point F1, as the focal point, and having a shape substantially corresponding to a part of a paraboloid of revolution, using the centerline 27 as an axis of rotation. As a result, the main reflection surface 15 can reflect the light in the range of from the rear end irradiation light 25 to the intermediate irradiation light 24, of the light irradiated from the light-emitting unit 7 in the forward direction.

The first sub-reflection surface 16 has a shape substantially corresponding to a curved surface formed by rotating once, about the centerline 27, a part of an ellipse designating two points, that is, the first focal point F1 and the second focal point F2, as the focal point. As a result, the first sub-reflection surface 16 can reflect the light in the range of from the intermediate irradiation light 24 to the front end irradiation light 23, of the light irradiated from the light-emitting unit 7, to the second sub-reflection surface 17 side.

The second sub-reflection surface 17 has a shape substantially corresponding to a curved surface formed by rotating once, about the centerline 27, a part of a parabola designating the second focal point F2 as the focal point, by using the centerline 27 as a center. As a result, the second sub-reflection surface 17 can reflect the light reflected by the first sub-reflection surface 16 in the forward direction, which has then passed through the second focal point F2 and reached the second sub-reflection surface 17.

The main reflection surface 15 can reflect the irradiation light from the light-emitting unit 7*a* for driving in the forward direction as well, in the range of from the rear end irradiation light 25*a* to the intermediate irradiation light 24*a* for driving. The first sub-reflection surface 16 can reflect the light in the range of from the intermediate irradiation light 24*a* for driving to the front end irradiation light 23*a* for driving to the second sub-reflection surface 17 side. The second sub-reflection surface 17 can reflect the reflection light from the first sub-reflection surface 16 (the light in the range of from the intermediate irradiation light 24*a* for driving to the front end irradiation light 23*a* for driving) in the forward direction.

The main reflector 11, the first sub-reflector 13, the second sub-reflector 14, and the relief portion 18 of the reflector substantially form a circle, as viewed from the front. On the other hand, the cross section of the main reflector 11 has a shape substantially corresponding to a part of a paraboloid of revolution on the main reflection surface 15. The cross section of the first sub-reflector 13 has a shape substantially corresponding to the curved surface of the first sub-reflection surface 16. Further, the cross section of the second sub-reflector 14 has a shape substantially corresponding to the curved surface of the second sub-reflection surface 17.

An insertion hole 22 for the lamp 6 is provided substantially at the center (inner end 14*b*) of the second sub-reflector 14. The inner end 11*b* of the main reflector 11 is formed integrally with the outer end 14*a* of the second sub-reflector 14, via a first corner 21 where the inner end 1*b* of the main reflector 11 becomes a mountain shape towards backward. The inner end 18*b* of the relief portion 18 is formed integrally with the outer end 11*a* of the main reflector 11, via a second corner 20 where the inner end 18*b* of the relief portion 18 becomes a mountain shape inward (toward the light-emitting unit 7 side) of the reflector. The rear end 13*b* of the first sub-reflector 13 is formed integrally with the outer end 18*a* of the relief portion 18, via a third corer 19 where the rear end 13*b* of the first sub-reflector 13 becomes a mountain shape outward. The front end 13*a* of the first sub-reflector 13 and the second corner 20 are located at substantially the same position in the lateral direction (in the direction of a line H substantially parallel with the centerline 17). Therefore, the first sub-reflector 13 is formed such that the lateral position of the whole part is located outside of the main reflector 11 formed inside of the relief portion 18.

The lamp 6 is inserted into the insertion hole 22 in the second sub-reflector 14, and assembled such that the light-emitting unit 7 in the lamp 6 is located at a predetermined position. The reflector in the vehicle lamp 1 is constructed based on the position of the light-emitting unit 7 in this state. A connector 9 is detachably connected to the base 8 of the lamp 6, so as to supply electricity.

The light in the range of from the rear end irradiation light 25 to the intermediate irradiation light 24, of the light irradiated from the light-emitting unit 7, is reflected by the main reflection surface 15 in the forward direction. At this time, the first sub-reflector 13 located ahead of the main reflector 11 is relieved outward of the main reflector 11 in the lateral direction by the relief portion 18. As a result, the reflection light reflected by the main reflection surface 15 can be irradiated in the forward direction without being blocked.

The remaining light of the irradiation light from the light-emitting unit 7, that is, the light in the range of from the intermediate irradiation light 24 to the front end irradiation light 23 is reflected by the first sub-reflection surface 16 toward the second sub-reflection surface 17. The light reflected toward the second sub-reflection surface 17 passes through the second focal point F2 and reaches the second sub-reflection surface 17, and is reflected in the forward direction by the second sub-reflection surface 17. As a result, the reflection light reflected by the first sub-reflection surface 16 is irradiated in the forward direction without being blocked by the lamp 6. Thus, the vehicle lamp 1 can effectively use the light from the light-emitting unit 7 in the light source 6.

Further, the light-emitting unit 7*a* for driving is lighted so as to emit light. The light in the range of from the rear end irradiation light 25*a* for driving to the intermediate irradiation light 24*a* for driving, of the light irradiated from the light-emitting unit 7*a* for driving, is reflected in the forward direction by the main reflection surface 15. The remaining light of the irradiation light from the light-emitting unit 7*a* for driving, that is, the light in the range of from the intermediate irradiation light 24*a* for driving to the front end irradiation light 23*a* for driving is reflected by the first sub-reflection surface 16 toward the second sub-reflection surface 17. The light having reached the second sub-reflection surface 17 is reflected in the forward direction by the second sub-reflection surface 17.

In the vehicle lamp 1, the first sub-reflector 13 is inclined inward, so that the light, which is one among lights irradiated by the light-emitting unit 7 of the lamp 6, in the range of from the front end irradiation light 23 to the intermediate irradiation light 24 is reflected by the first sub-reflection surface 16 toward the second sub-reflection surface 17. Normally, the light in this range is reflected in the forward direction by a reflection surface (a virtual main reflector 28) located ahead and outside of the outer end 11*a* of the main reflector 11. However, since the first sub-reflector 13 is inclined inward, the vehicle lamp 1 can be made small in the back and forth direction and in the width direction, as compared with the virtual main reflector 28.

Further, in the vehicle lamp 1, the light irradiated from the light-emitting unit 7 is divided into two regions, and each light is reflected in the forward direction by the main reflector 11, the first sub-reflector 13 and the second sub-reflector 14. As a result, the light in the irradiated substantial whole area can be used as the light illuminating one direction effectively.

Since the first sub-reflector 13 has a shape narrowed from the rear end 13*b* (the third corner 19) to the front end 13*a*, the inner diameter D1 at the front end 13*a* is smaller than the outer diameter D2 at the rear end 13*b*. As a result, in the vehicle lamp 1, light-emitting units in a small circular shape (the main reflection surface 15 and the second sub-reflection surface 17) are located in a light-emitting unit in a large circular shape (the front side of the first sub-reflector 13), and hence a novel design can be obtained. The vehicle lamp 1 can also correspond to a slant nose and a narrowed shape of the vehicle. Further, in the vehicle lamp 1, the design effect can be improved by applying aluminum evaporation or silver plating on the front face (a face opposite to the lamp lens 3) of the first sub-reflector 13, so as to provide a decorated face or an ornamental face.

The light-emitting unit 7*a* for driving is located behind the first focal point F1, which is the focal point of the main reflection surface 15, and at the same time, is one of the two focal points of the first sub-reflector 16. Therefore, the irradiation light from the light-emitting unit 7*a* for driving, reflected by the main reflection surface 15, is diffused more, as compared with the light obtained by reflecting the irradiation light from the light-emitting unit 7. Further, the irradiation light from the light-emitting unit 7*a* for driving, reflected by the first sub-reflection surface 16, reaches inward of the second sub-reflection surface 17, as compared with the irradiation light from the light-emitting unit 7, reflected by the first sub-reflection surface 16. Therefore, the irradiation light from the light-emitting unit 7*a* for driving reflected by the first sub-reflection surface 16 is diffused and reflected in the forward direction, as compared with the light from the light-emitting unit 7, even when the irradiation light is reflected by the second sub-reflection surface 17. As a result, when the light-emitting unit 7*a* for driving is lighted to emit light, a wider range at the forward of the vehicle can be illuminated. In the vehicle lamp 1, the light when the light from the light-emitting unit 7 is reflected in the forward direction is normally made not to illuminate far away as the light for passing by. Therefore, in this case, the light obtained by reflecting the light from the light-emitting unit 7*a* for driving can illuminate farther.

As a result, in the present invention, the vehicle lamp 1, whose dimension is limited, can be accommodated within a predetermined dimension, and can effectively use substantially the whole light irradiated from the lamp 6, thereby improving the performance of illuminating in the forward direction. Further, in the present invention, the degree of freedom in design of the vehicle can be greatly increased, by using the vehicle lamp 1 as the vehicle headlamp, thereby improving the marketing value.

Figure 6:
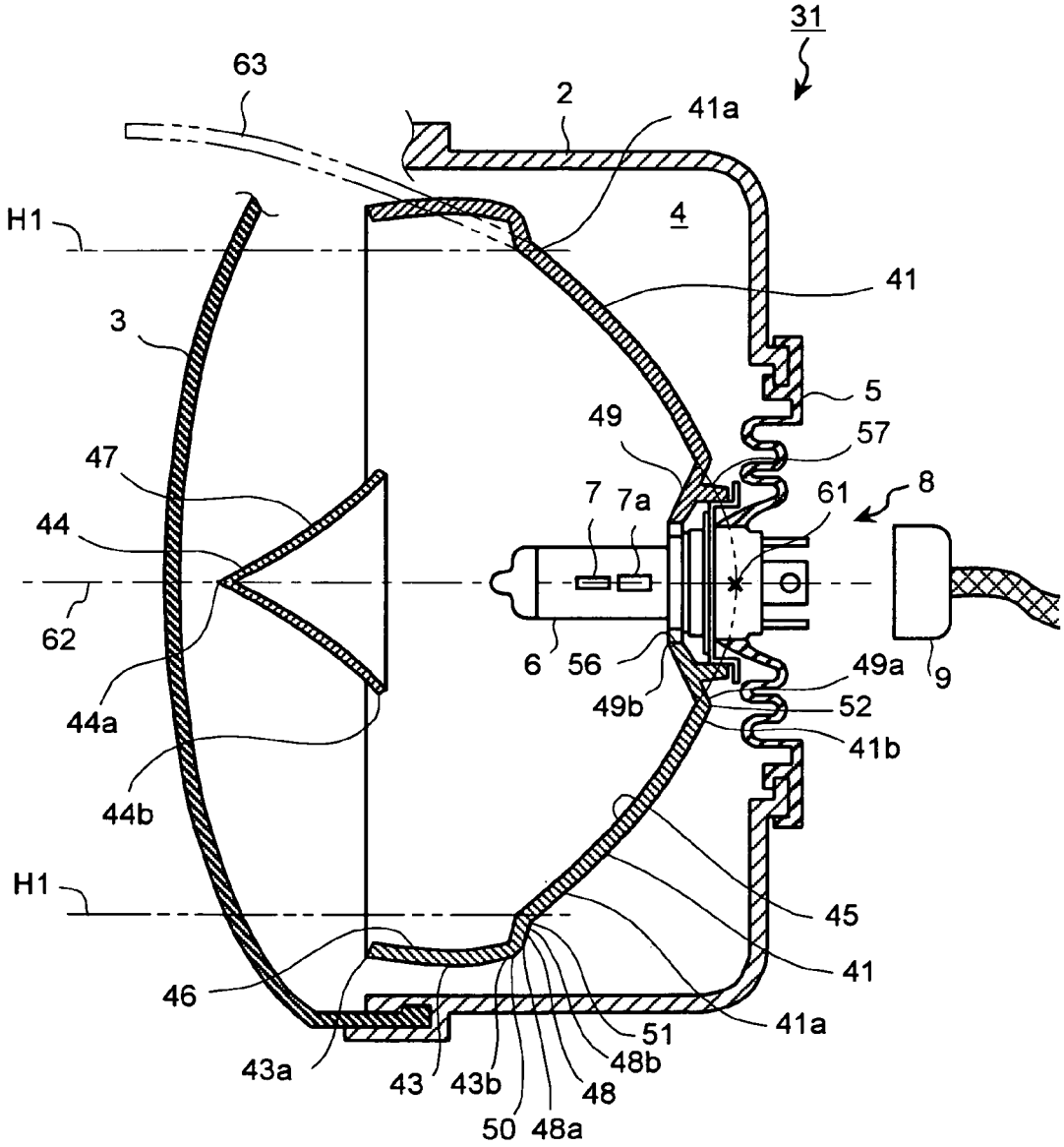
FIG. 6 a partial cross section of a vehicle lamp according to a second embodiment of the present invention.
Figure 7:
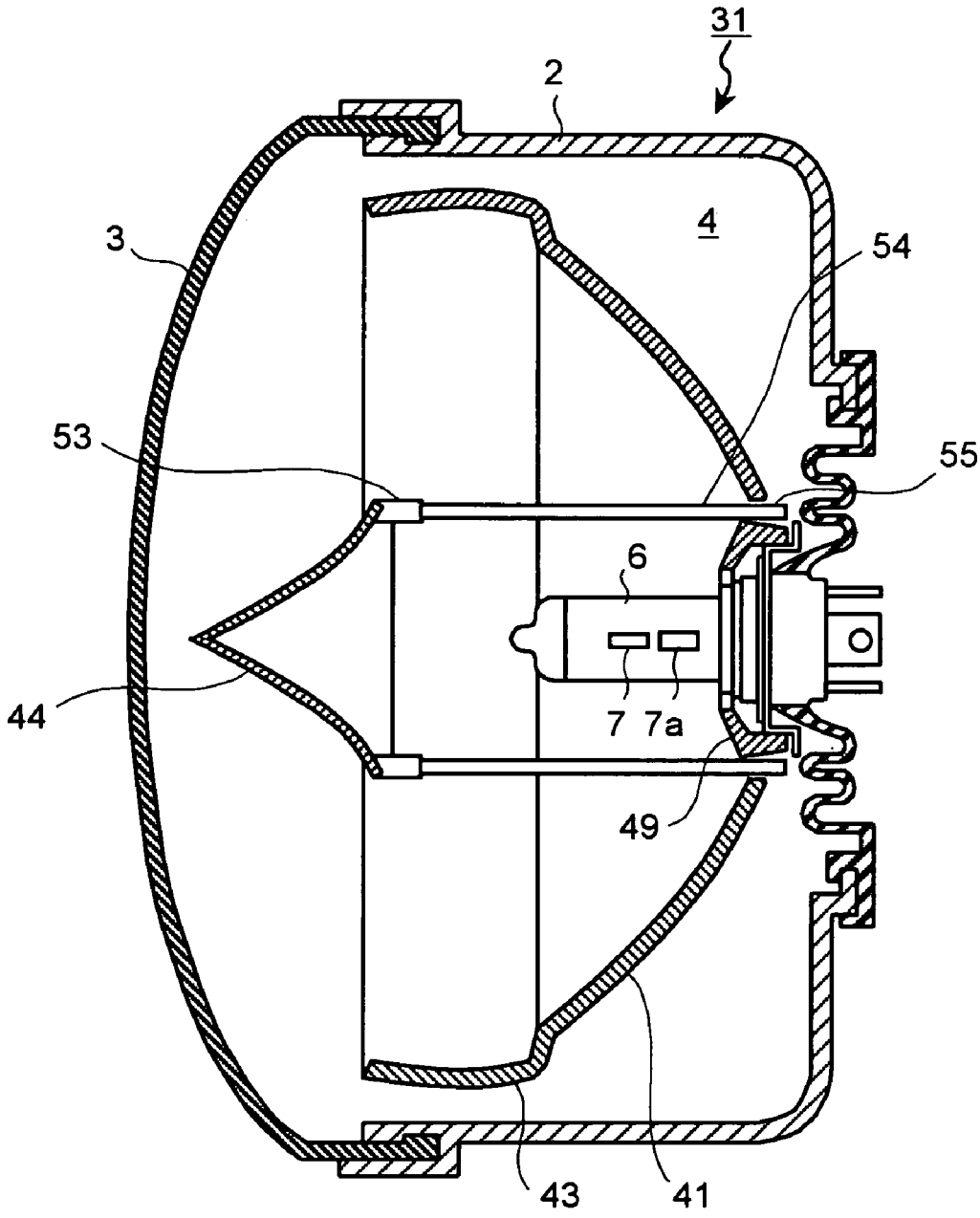
FIG. 7 depicts fixing members that is provided in the vehicle lamp according to the second embodiment.
Figure 8:
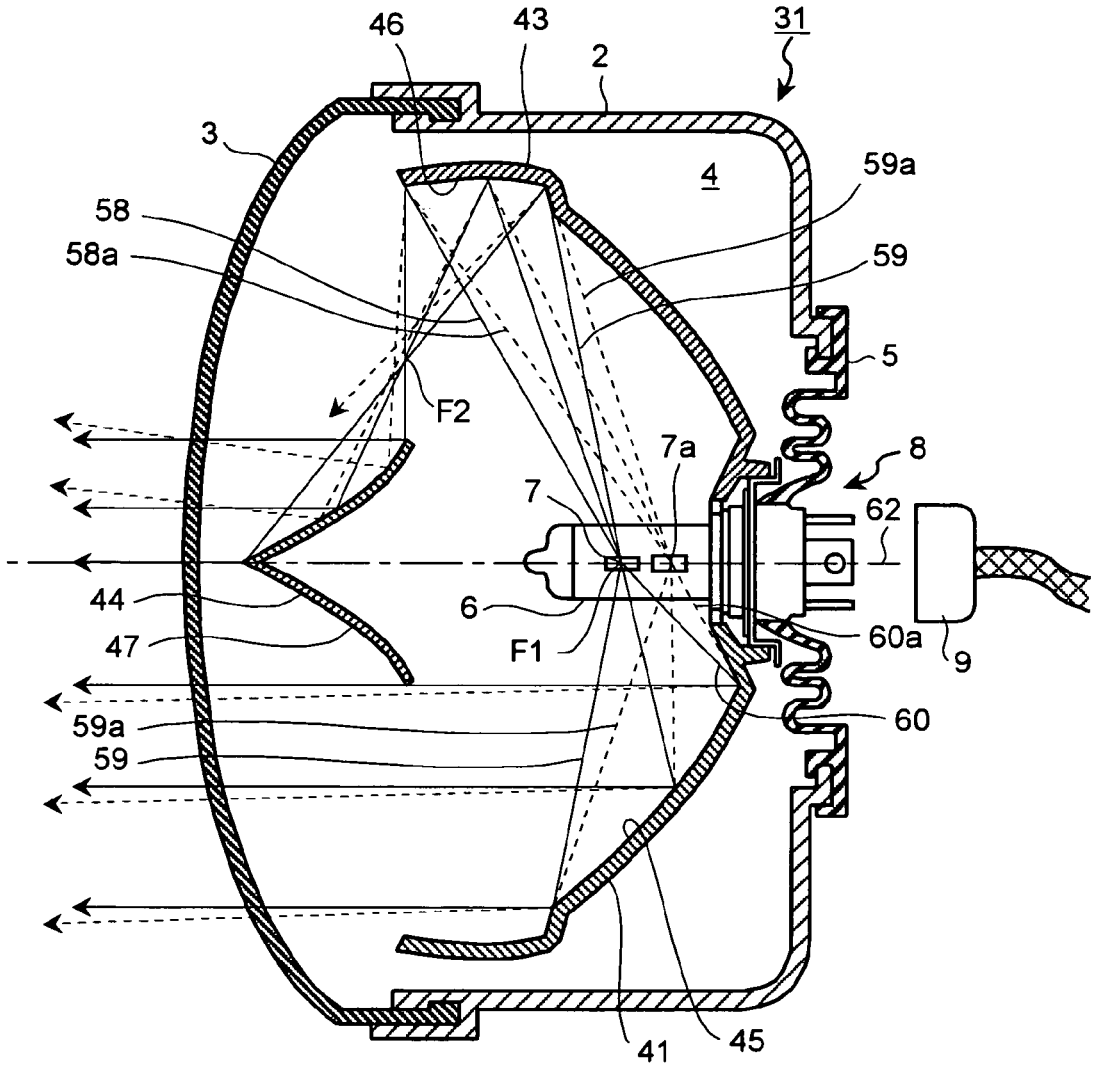
FIG. 8 depicts a reflection path of irradiation light from the vehicle lamp according to the second embodiment.
Figure 9:
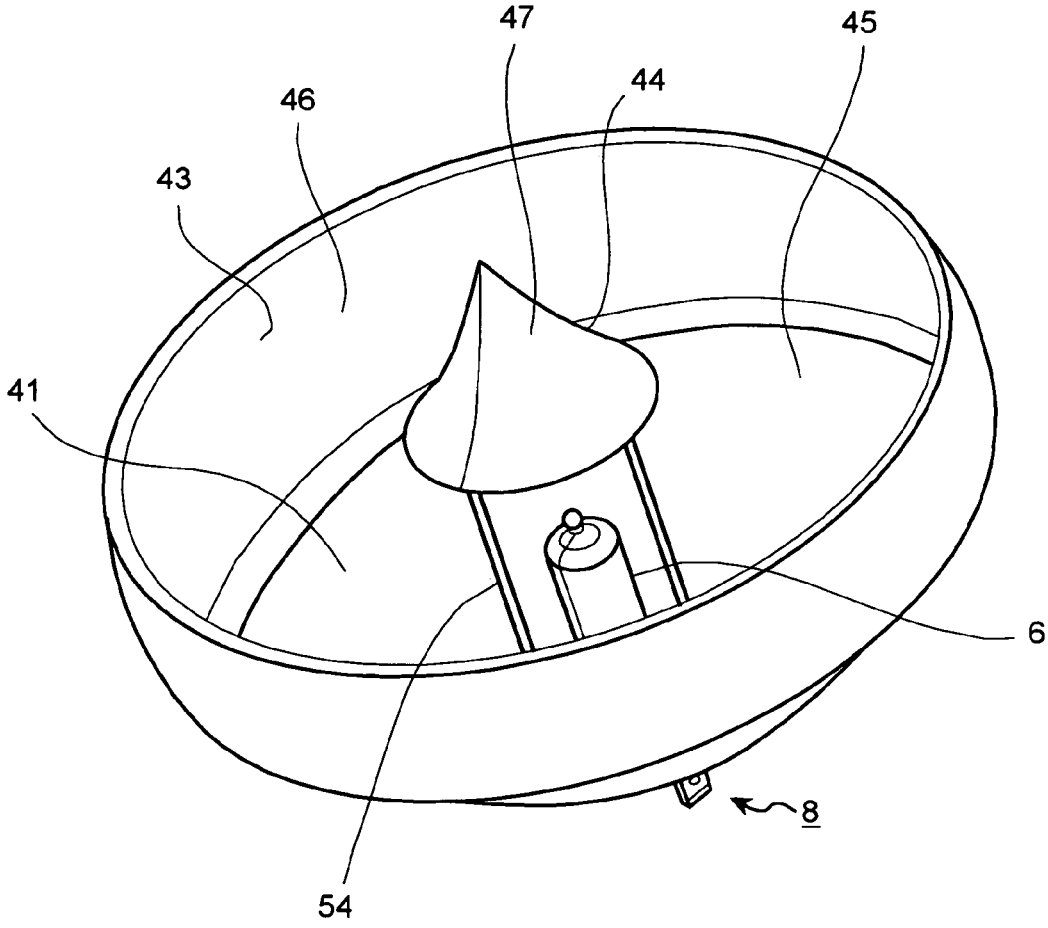
FIG. 9 is a schematic diagram for illustrating main parts of the vehicle lamp according to the second embodiment.

FIGS. 6 to 9 depict a vehicle lamp according to a second embodiment of the present invention. In these figures, same reference signs as in FIGS. 1 to 5 refer to same parts. In the lamp chamber 4 of the vehicle lamp 31, a reflector is arranged. The reflector includes a main reflector 41, a first sub-reflector 43, an adjusting portion 48, and a relief portion 49 integrally formed, and a second sub-reflector 44 separately formed. The first sub-reflector 43, the adjusting portion 48, the main reflector 41, and the relief portion 49 are integrally formed in order from the outside to the inside.

A main reflection surface 45 is provided on the front face of the main reflector 41, a first sub-reflection surface 46 on the face facing the inside of the first sub-reflector 43, and a second sub-reflection surface 47 on the face facing outward or forward of the second sub-reflector 44, respectively. Further, it is assumed that a point located near the light-emitting unit 7 is a first focal point F1, a point located at a predetermined position between the first sub-reflection surface 46 and the second sub-reflection surface 47 is a second focal point F2, and a straight line passing through the first focal point F1 in the back and forth direction is a centerline 62.

The main reflection surface 45 has a main reflector apex 61, being a virtual apex, on the centerline 62, designating the first focal point F1 as the focal point, and having a shape substantially corresponding to a part of a paraboloid of revolution, using the centerline 62 as an axis of rotation. As a result, the main reflection surface 45 can reflect the light in the range of from the rear end irradiation light 60 to the intermediate irradiation light 59, of the light irradiated from the light-emitting unit 7 in the forward direction.

The first sub-reflection surface 46 has a shape substantially corresponding to a curved surface formed by rotating once, about the centerline 62, a part of an ellipse designating two points, that is, the first focal point F1 and the second focal point F2, as the focal point. As a result, the first sub-reflection surface 46 can reflect the light in the range of from the intermediate irradiation light 59 to the front end irradiation light 58, of the light irradiated from the light-emitting unit 7, to the second sub-reflection surface 47 side.

The second sub-reflection surface 47 has a shape substantially corresponding to a curved surface formed by rotating once, about centerline 62, a part of a parabola designating the second focal point F2 as the focal point. As a result, the second sub-reflection surface 47 can reflect the light reflected by the first sub-reflection surface 46 in the forward direction, which has then passed through the second focal point F2 and reached the second sub-reflection surface 47.

The main reflection surface 45 can reflect the irradiation light from the light-emitting unit 7*a* for driving in the forward direction as well, in the range of from the rear end irradiation light 60*a* to the intermediate irradiation light 59*a* for driving. The first sub-reflection surface 46 can reflect the light in the range of from the intermediate irradiation light 59*a* for driving to the front end irradiation light 58*a* for driving to the second sub-reflection surface 47 side. The second sub-reflection surface 47 can reflect the reflection light from the first sub-reflection surface 46 (the light in the range of from the intermediate irradiation light 59*a* for driving to the front end front end irradiation light 58*a* for driving) in the forward direction.

The main reflector 41, the first sub-reflector 43, the second sub-reflector 44, and the adjusting portion 48 of the reflector substantially form a circle, as viewed from the front. On the other hand, the cross section of the main reflector 41 has a shape substantially corresponding to a part of a paraboloid of revolution on the main reflection surface 45. The cross section of the first sub-reflector 43 has a shape substantially corresponding to the curved surface of the first sub-reflection surface 46. Further, the cross section of the second sub-reflector 44 has a shape substantially corresponding to the curved surface of the second sub-reflection surface 47.

An insertion hole 56 for the lamp 6 is provided substantially at the center (inner end 49*b*) of the relief portion 49. The inner end 41*b* of the main reflector 41 is formed integrally with the outer end 49*a* of the relief portion 49, via a first corner 52 where the inner end 41*b* of the main reflector 41 becomes a mountain shape towards backward. The inner end 48*b* of the adjusting portion 48 is formed integrally with the outer end 41*a* of the main reflector 41, via a second corner 51 where the inner end 48*b* of the adjusting portion 48 becomes a mountain shape inward (toward the light-emitting unit 7 side) of the reflector.

The rear end 43*b* of the first sub-reflector 43 is formed integrally with the outer end 48*a* of the adjusting portion 48, via a third corer 50 where the rear end 33*b* of the first sub-reflector 43 becomes a mountain shape outward. The first sub-reflector 43 is formed such that the whole part thereof is located outside of the second corner 51 in the lateral direction (in a direction of line H1 substantially parallel with the centerline 62). As a result, the whole part of the first sub-reflector 43 is located outside of the main reflector 41, which is located inside of the second corner 51 in the lateral direction.

The first sub-reflection surface 46 and the second sub-reflection surface 47 are formed such that the focal point, of the two focal points of the first sub-reflection surface 46, which is not on the centerline 62, and the focal point of the second sub-reflection surface 47 are located substantially at the same position on the second focal point F2, due to the size of the adjusting portion 48 and the balance between the angles of the second corner 51 and the third corner 50.

As described above, the insertion hole 56 for the lamp 6 is provided inside of the inner end 49*b* of the relief portion 49, and a cylindrical lamp fixing portion 57 is provided outside of the insertion hole 56 and on the back face of the relief portion 49. The lamp 6 is inserted into the lamp fixing portion 57 and the insertion hole 56, and fixed to the lamp fixing portion 57 so that the light-emitting unit 7 in the lamp 6 is located at a predetermined position. The reflector in the vehicle lamp 31 is constructed based on the position of the light-emitting unit 7 in the lamp 6 in this state. A connector 9 is detachably connected to the base 8 of the lamp 6, so as to supply electricity.

In the second sub-reflector 44, a plurality of bosses 53 is provided rearward on the back face thereof. A fixing portion 55 is provided in the relief portion 49. The fixing portion 55 is provided in the same number as that of the bosses 53, at the same position in the lateral direction with the bosses 53. The second sub-reflector 44 is fixed to the relief portion 49, by connecting and fixing the boss 53 and the fixing portion 55 with a fixing member 54.

The light in the range of from the rear end irradiation light 60 to the intermediate irradiation light 59, of the light irradiated from the light-emitting unit 7, is reflected in the forward direction by the main reflection surface 45. At this time, the first sub-reflector 43 and the second sub-reflector 44 are located ahead of the main reflection surface 45, but the first sub-reflector 43 is relieved outward of the main reflection surface 45 in the lateral direction, by the adjusting portion 48. Further, with respect to the second sub-reflector 44, the main reflector 41 itself where the main reflection surface 45 is provided is relieved outward of the second sub-reflector 44 by the relief portion 49. As a result, the reflection light reflected by the main reflection surface 45 can be irradiated in the forward direction without being blocked.

The remaining light of the irradiation light from the light-emitting unit 7, that is, the light in the range of from the intermediate irradiation light 59 to the front end irradiation light 58 is reflected by the first sub-reflection surface 46 toward the second sub-reflection surface 47. The light reflected toward the second sub-reflection surface 47 passes through the second focal point F2 and reaches the second sub-reflection surface 47, and is reflected in the forward direction by the second sub-reflection surface 47. As a result, the first sub-reflection surface 46 and the second sub-reflection surface 47, that is, the first sub-reflector 43 and the second sub-reflector 44 functions as one sub-reflector, by combining these two sub-reflectors. At this time, the reflection light reflected by the first sub-reflection surface 46 is irradiated toward the second sub-reflection surface without being blocked by the lamp 6. Thus, the vehicle lamp 31 can effectively use the light from the light-emitting unit 7 in the light source 6.

Further, the light-emitting unit 7*a* for driving is lighted so as to emit light. The light in the range of from the rear end irradiation light 60*a* for driving to the intermediate irradiation light 59*a* for driving, of the light irradiated from the light-emitting unit 7*a* for driving, is reflected in the forward direction by the main reflection surface 45. The remaining light of the irradiation light from the light-emitting unit 7*a* for driving, that is, the light in the range of from the intermediate irradiation light 59*a* for driving to the front end irradiation light 58*a* for driving is reflected by the first sub-reflection surface 46 toward the second sub-reflection surface 47. The light having reached the second sub-reflection surface 47 is reflected in the forward direction by the second sub-reflection surface 47.

In the vehicle lamp 31, the first sub-reflector 43 is inclined inward, so that the light in the range of from the front end irradiation light 58 to the intermediate irradiation light 59 is reflected by the first sub-reflection surface 46 toward the second sub-reflection surface 47. Normally, the light in this range is reflected in the forward direction by a reflection surface (a virtual main reflector 63) located ahead of the outer end 41*a* of the main reflector in the vehicle lamp 31, that is, ahead and outside of the main reflector 41. In the vehicle lamp 31, however, since the first sub-reflector 43 is inclined inward, the first sub-reflection surface 46 for reflecting the light in this range is closer to the lamp 6, as compared with the virtual main reflector 63. As a result, in the vehicle lamp 31, the first sub-reflector 43 reflects the light before the irradiated light diffuses, and hence the size of the first sub-reflector 43 can be reduced.

Further, the virtual main reflector 63, which is required in the normal vehicle lamp for reflecting the light in this range, is not necessary in the vehicle lamp 31. Therefore, in the vehicle lamp 31, the size in the back and forth direction and the whole width of the reflector can be made small, as compared with the instance when the light from the light-emitting unit 7 is directly reflected in the forward direction. In the vehicle lamp 1, the light irradiated from the light-emitting unit 7 is divided into two regions, and each light is reflected in the forward direction by the main reflector 41, the first sub-reflector 43 and the second sub-reflector 44. As a result, the light in the irradiated substantial whole area can be used as the light illuminating one direction effectively.

Since the second sub-reflector 44 has a shape narrowed from the rear end 44*b* to the front end 44*a*, with the front end 44*a* being a sharp apex, is located substantially at the center of the main reflector 41 and the first sub-reflector 43, and located ahead of the lamp 6 to cover the lamp 6. As a result, a novel design can be obtained, since the sharp shape of the second sub-reflector 44 covering the lamp 6 is visually remarkable. Further, in the vehicle lamp 31, the design effect can be improved by applying aluminum evaporation or silver plating on the front face (a face opposite to the lamp lens 3) of the second sub-reflector 44, so as to provide the second sub-reflection surface 47.

The light-emitting unit 7*a* for driving is located behind the first focal point F1, which is the focal point of a paraboloid of substantially the same shape as the main reflection surface 45, and at the same time, is one of the two focal points of an ellipse of substantially the same shape as the first sub-reflector 46. Therefore, the irradiation light from the light-emitting unit 7*a* for driving, reflected by the main reflection surface 45, is diffused more, as compared with the light obtained by reflecting the irradiation light from the light-emitting unit 7. Further, the irradiation light from the light-emitting unit 7*a* for driving, reflected by the first sub-reflection surface 46, reaches inward of the second sub-reflection surface 47, as compared with the irradiation light from the light-emitting unit 7, reflected by the first sub-reflection surface 46. Therefore, the irradiation light from the light-emitting unit 7*a* for driving reflected by the first sub-reflection surface 46 is diffused and reflected in the forward direction, as compared with the light from the light-emitting unit 7, even when the irradiation light is reflected by the second sub-reflection surface 47. As a result, when the light-emitting unit 7*a* for driving is lighted to emit light, forward and wider range of the vehicle can be illuminated. The light when the light from the light-emitting unit 7 is reflected in the forward direction is normally made not to illuminate far away as the light for passing by. Therefore, in this case, the light obtained by reflecting the light from the light-emitting unit 7*a* for driving can illuminate farther.

As a result, in the present invention, the vehicle lamp 31, whose dimension is limited, can be accommodated within a predetermined dimension, and can effectively use substantially the whole light irradiated from the lamp 6, thereby improving the performance of illuminating forward. Further, since the lamp 6 is blocked by the second sub-reflector 44 located ahead of the lamp 6 and cannot be viewed from outside, the appearance at the time of light out becomes novel as compared with the conventional vehicle lamp. As a result, in the present invention, the degree of freedom in design of the vehicle can be greatly increased, by using the vehicle lamp 31 as the vehicle headlamp, and the appearance has a novel image that cannot be viewed in the conventional vehicle lamp.

Figure 10:
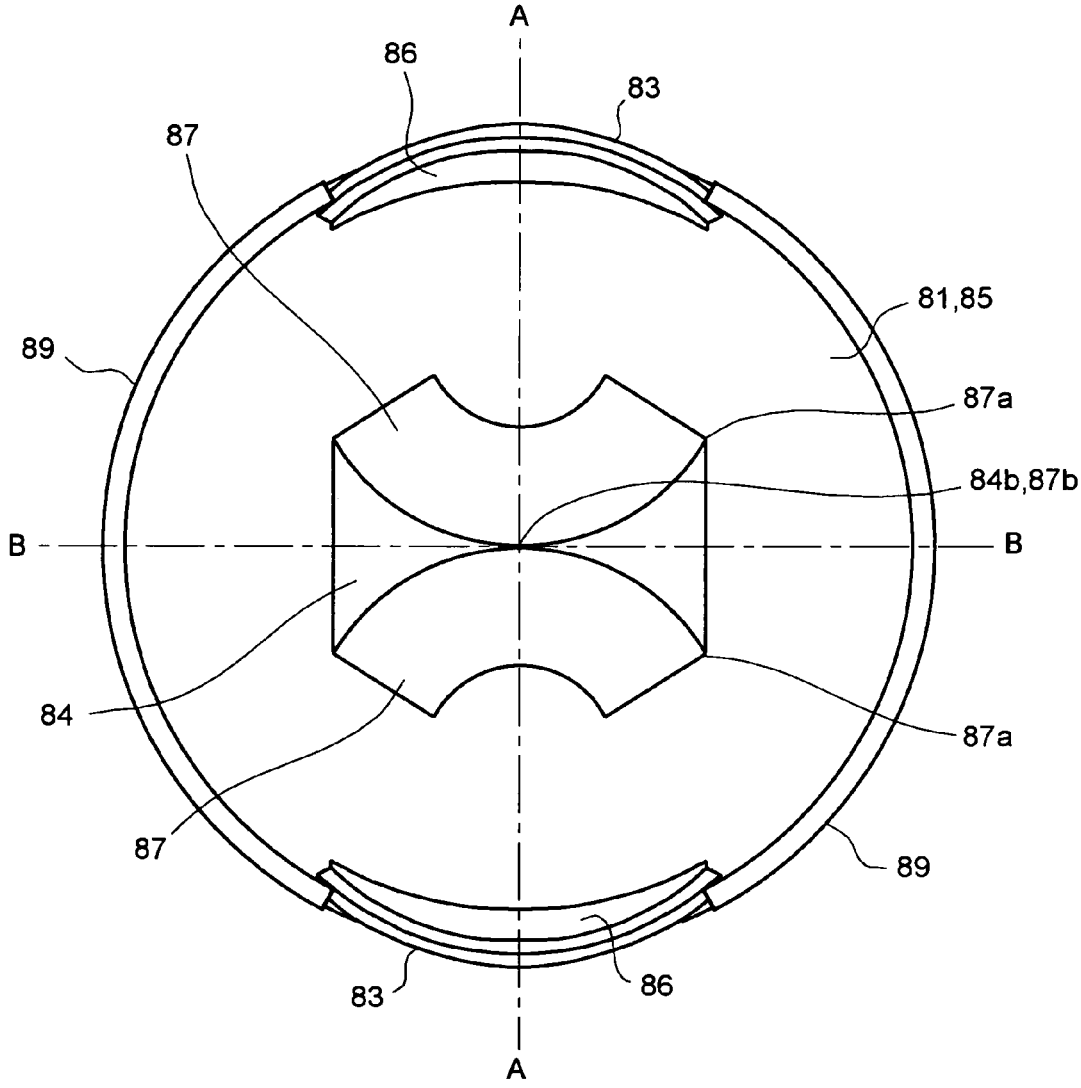
FIG. 10 is a front view for illustrating main parts of a vehicle lamp according to a third embodiment.
Figure 11:
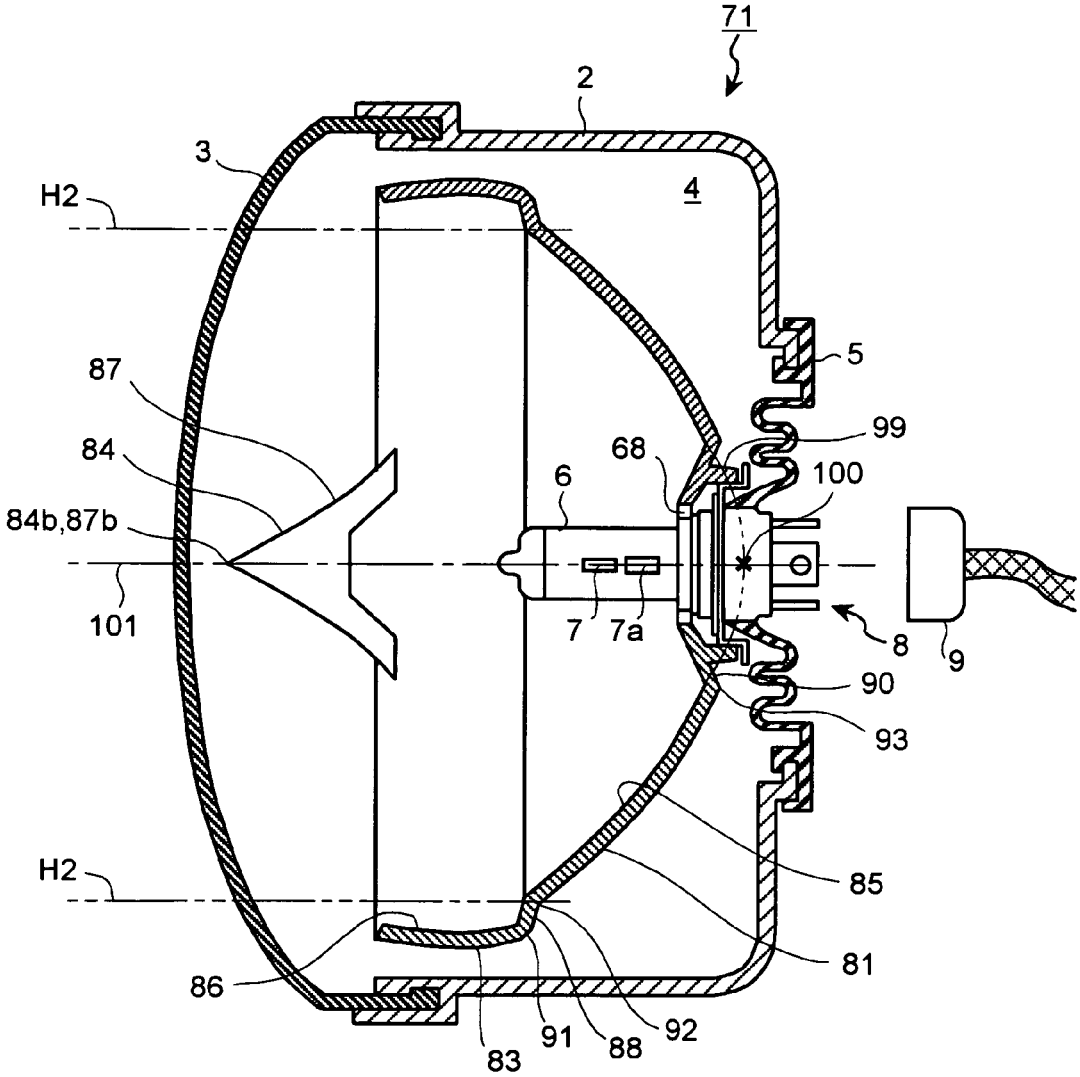
FIG. 11 is a cross section cut along the line A—A in FIG. 10.
Figure 12:
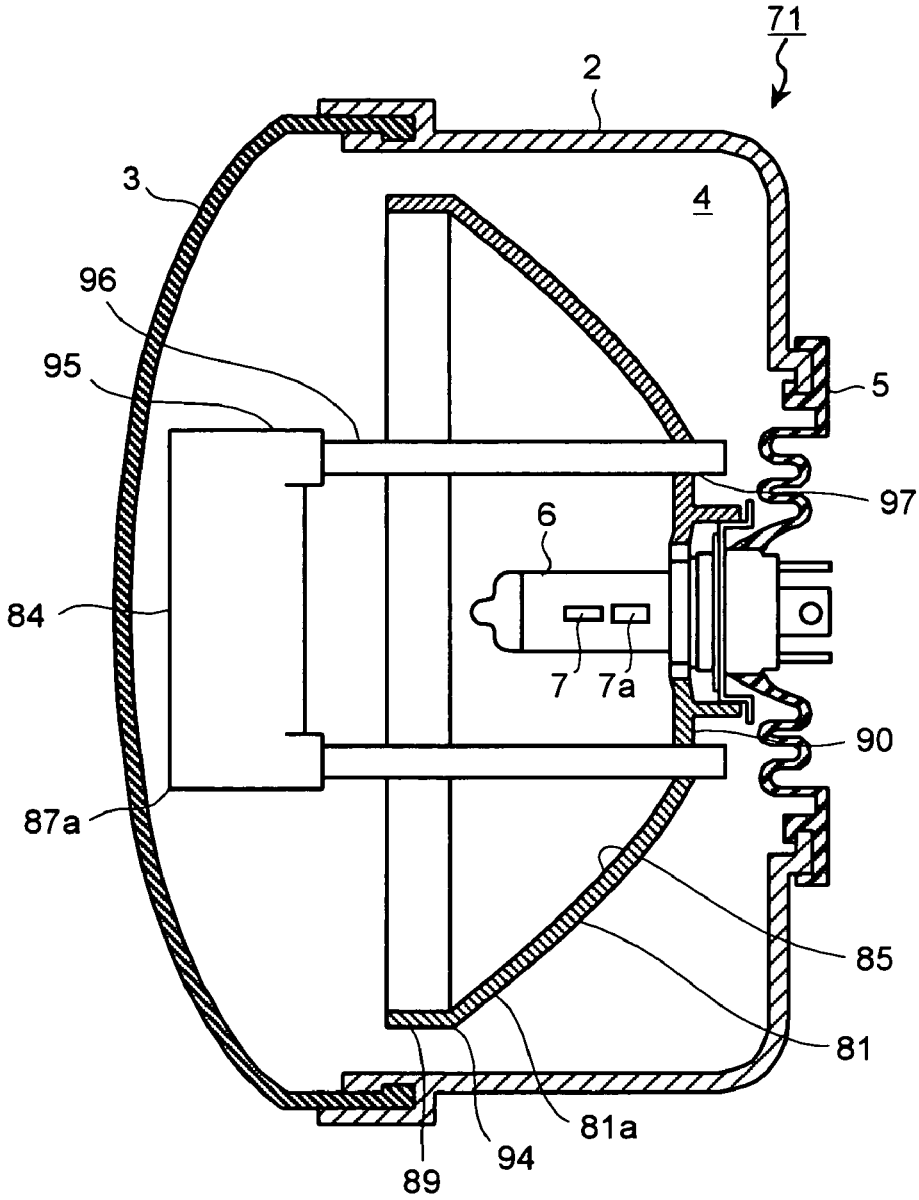
FIG. 12 is a cross section cut along the line B—B in FIG. 10.
Figure 13:
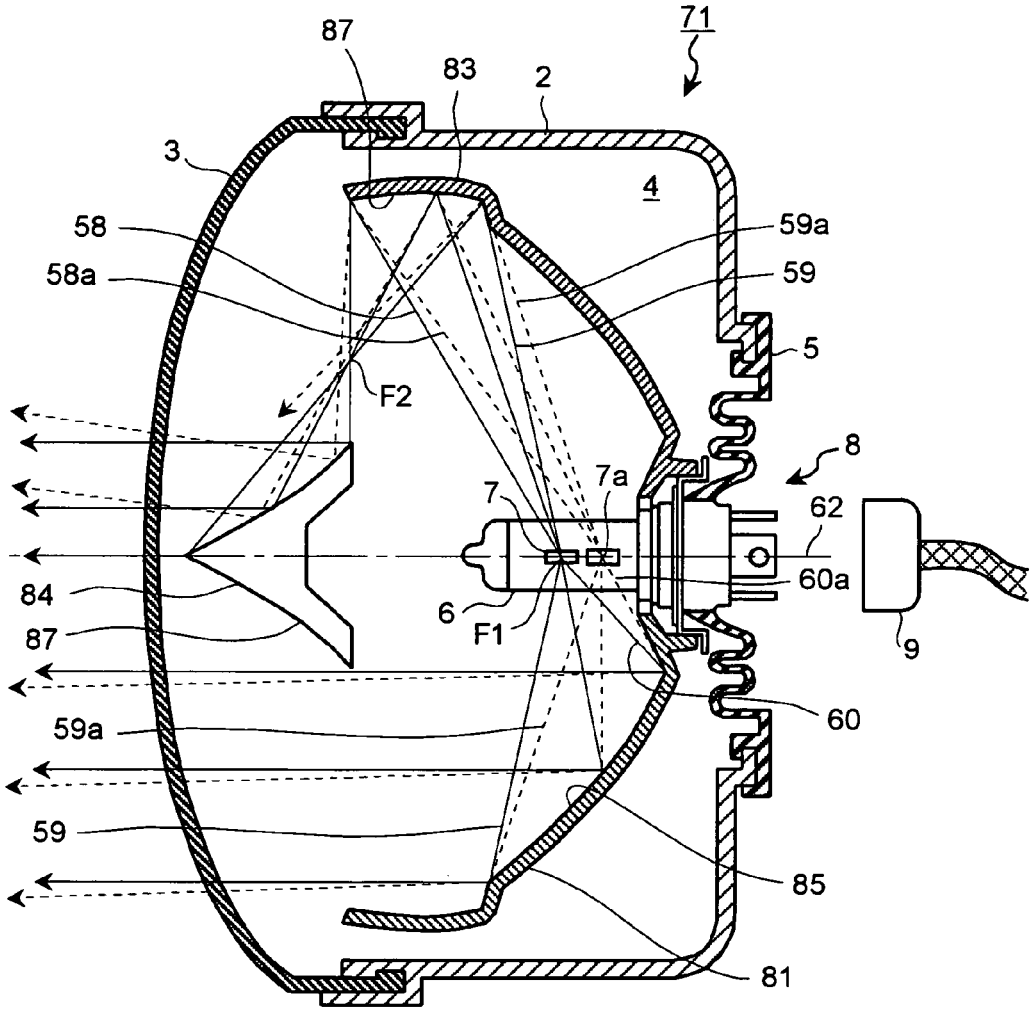
FIG. 13 depicts a reflection path of the irradiation light from the vehicle lamp according to the third embodiment in the cross section along the line A—A.
Figure 14:
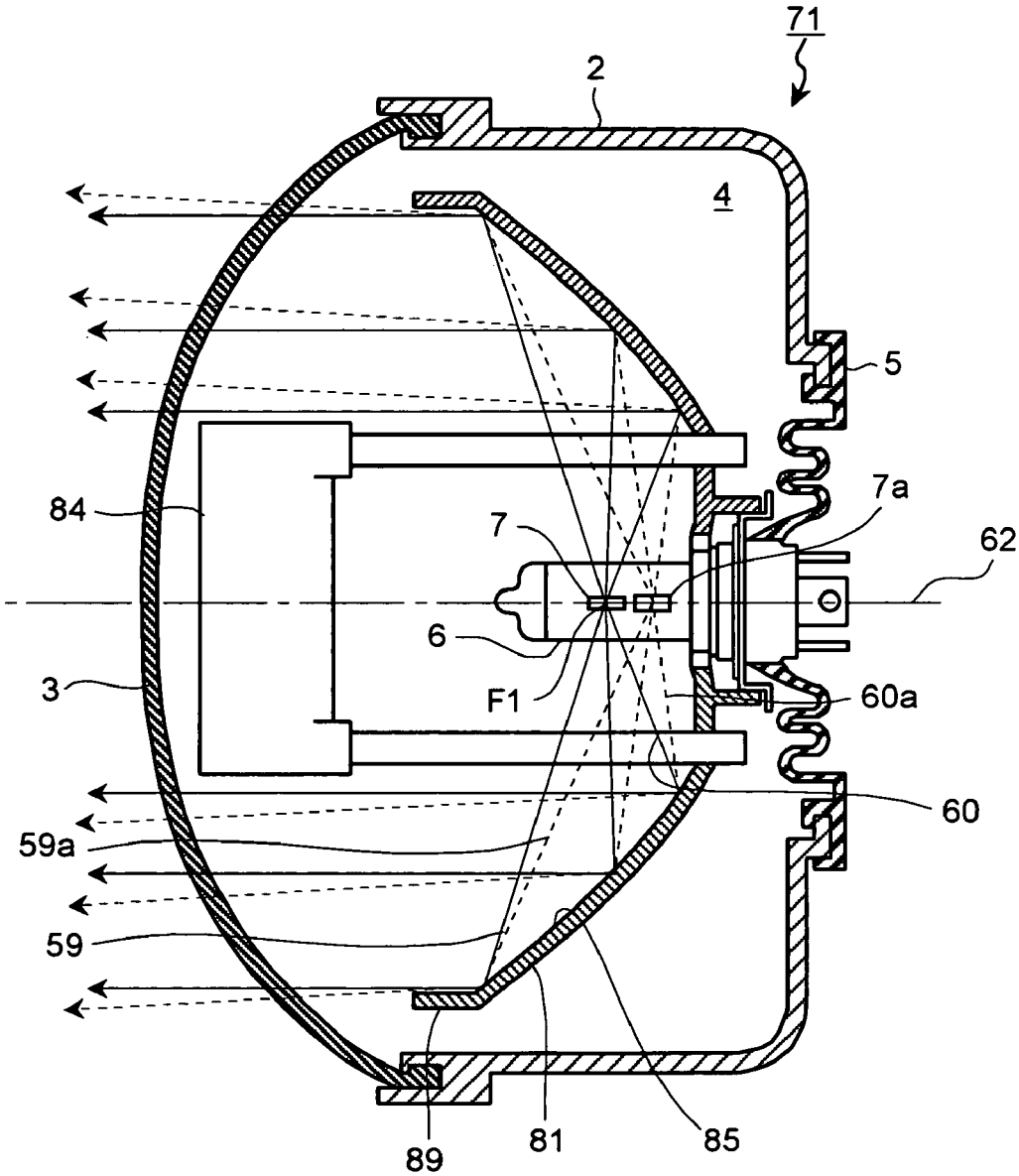
FIG. 14 depicts a reflection path of the irradiation light from the vehicle lamp according to the third embodiment in the cross section along the line B—B.
Figure 15:
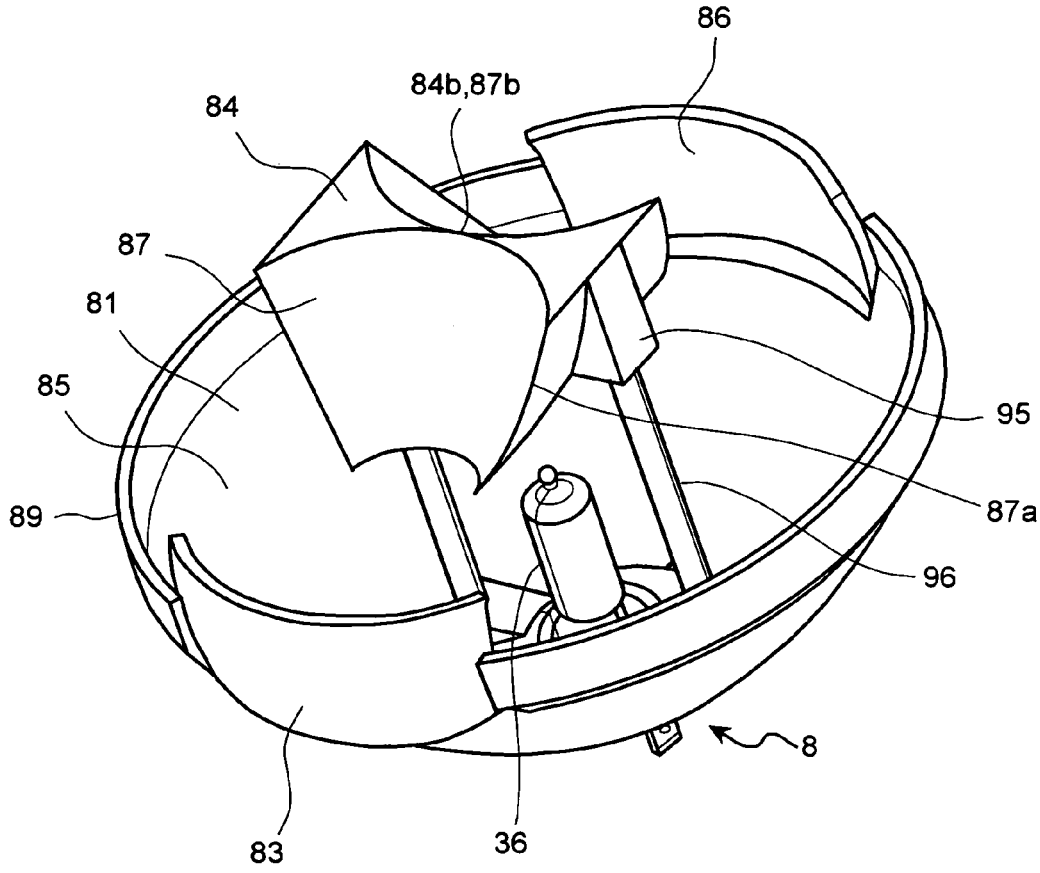
FIG. 15 is a schematic diagram for illustrating main parts of the vehicle lamp according to the third embodiment.

FIGS. 10 to 15 depict a vehicle lamp according to a third embodiment of the present invention. In these figures, same reference signs as in FIGS. 1 to 9 refer to same parts. In the third embodiment, as viewed from the front, a first sub-reflector 83, which functions similarly to the first sub-reflector 43 in the second embodiment, is formed in two places, outside of a main reflector 81 formed in a circular shape as in the second embodiment, in a predetermined range in point symmetry about the center of the circle, via an adjusting portion 88. In the portion outside of the main reflector 81, where the first sub-reflector 83 is not formed, an edge is directly formed outside of the main reflector 81 without the adjusting portion 88. Further, the second sub-reflector 84 is provided at a position and in a range where the reflection light from the first sub-reflector 83 can be reflected in the forward direction, as the second sub-reflector 44 in the second embodiment. The first sub-reflector 83, the adjusting portion 88 or the edge 89, the main reflector 81, and a relief portion 90 are formed integrally from the outside toward the inside.

A main reflection surface 85 is provided on the front face of the main reflector 81, a first sub-reflection surface 86 on the face facing the inside of the first sub-reflector 83, and a second sub-reflection surface 87 on the face facing outward or forward of the second sub-reflector 84, respectively.

The main reflection surface 85 is provided in the same range as in the second embodiment, and has a main reflector apex 100, being a virtual apex, on the centerline 101, designating the first focal point F1 as the focal point, and having a shape substantially corresponding to a part of a paraboloid of revolution, using the centerline 101 as an axis of rotation. As a result, the main reflection surface 85 can reflect the light in the range of from the rear end irradiation light 60 to the intermediate irradiation light 59, of the light irradiated from the light-emitting unit 7 in the forward direction.

Since the first sub-reflection surface 86 is provided in the first sub-reflector 83, the first sub-reflection surface 86 has a shape substantially corresponding to a curved surface formed by rotating a part of an ellipse designating two points, that is, the first focal point F1 and the second focal point F2, as the focal point, about the centerline 101, in a predetermined range or in the range where the first sub-reflector 83 is provided. As a result, the first sub-reflection surface 86 can reflect the light in the range of from the intermediate irradiation light 59 to the front end irradiation light 58, of the light irradiated from the light-emitting unit 7, to the second sub-reflection surface 87 side. Further, since the two first sub-reflectors 83 are provided in point symmetry, about the center of the circle forming the main reflector 81 as viewed from the front, the first sub-reflection surfaces 86 are opposite to each other.

The second sub-reflection surface 87 functions together with the first sub-reflection surface 86, similarly to the first sub-reflection surface 46 and the second sub-reflection surface 47 in the second embodiment, and hence it has a shape substantially corresponding to a curved surface formed by rotating a part of a parabola designating the second focal point F2 as the focal point, about the centerline 101 in a predetermined range. The specific range of this predetermined range corresponds to a range where the first sub-reflection surface 86 is provided. In other words, when the reflector is viewed from the front, the first sub-reflection surfaces 86 are formed in two places, so as to face inward in point symmetry about the center of a circle, which forms the reflector. Hence, the two second sub-reflection surfaces 87 are formed facing outward in the opposite direction. As a result, the second sub-reflection surface 87 can reflect the light reflected by the first sub-reflection surface 86 in the forward direction, which has then passed through the second focal point F2 and reached the second sub-reflection surface 87.

The main reflector 81 of the reflector has a substantially circular shape, as viewed from the front. The first sub-reflector and the edge 89 are also in a circular shape collectively, as viewed from the front. On the other hand, the cross section of the main reflector 81 has a shape substantially corresponding to a part of a paraboloid of revolution on the main reflection surface 85. The cross section of the first sub-reflector 83 has a shape substantially corresponding to the curved surface of the first sub-reflection surface 86. Further, the cross section of the second sub-reflector 84 has a shape substantially corresponding to the curved surface of the second sub-reflection surface 87.

An insertion hole 98 for the lamp 6 is provided substantially at the center of the relief portion 90, as in the vehicle lamp 31 in the second embodiment. The relief portion 90 and the main reflector 81 are formed integrally with each other, via a first corner 93 in a mountain shape towards backward. The main reflector 81 and the adjusting portion 88 are formed integrally with each other, via a second corner 92 in a mountain shape inward (toward the light-emitting unit 7 side) of the reflector. The adjusting portion 88 and the first sub-reflector 83 are formed integrally with each other, via a third corner 91 in a mountain shape outward.

In a portion where the first sub-reflector 83 and the adjusting portion 88 are not provided, when the main reflector 81 is viewed from the front, the edge 89 is provided in a predetermined width, ahead of the outer end 81*a* of the main reflector 81. The edge 89 and the outer end 81*a* of the main reflector 81 form a fourth corner 94. The edge 89 is formed forward from the fourth corner 94, and the main reflector 81 is formed so as to expand outward. Therefore, the fourth corner 94 is formed in a mountain shape outward.

The whole part of the first sub-reflector 83 is located outside of the second corner 92 in the lateral direction (in a direction of line H2 substantially parallel with the centerline 101). As a result, the whole part of the first sub-reflector 83 is located outside of the main reflector 81, which is located inside of the second corner 92 in the lateral direction.

The first sub-reflection surface 86 and the second sub-reflection surface 87 are formed such that the focal point, of the two focal points of the first sub-reflection surface 86, which is not on the centerline 101, and the focal point of the second sub-reflection surface 87 are located substantially at the same position on the second focal point F2, due to the size of the adjusting portion 88 and the balance between the angles of the second corner 92 and the third corner 91.

Bosses 95 are provided rearward between the ends 87*a* of the second sub-reflection surfaces, at the lateral ends (when the second sub-reflection surface 87 is viewed from the front, a direction orthogonal to the back and forth direction) of the two second sub-reflection surfaces 87. Fixing portions 97 are provided in the relief portion 90 in the same number as that of the bosses 95, at the same position in the lateral direction with the bosses 95. The second sub-reflector 84 is fixed to the main reflector 81, by connecting the boss 95 and the fixing portion 97 with a fixing member 96.

As described above, the insertion hole 98 is provided in the relief portion 90, which is provided inside of the main reflector 81, and a cylindrical lamp fixing portion 99 is provided outside of the insertion hole 98 and on the back face of the relief portion 90. The lamp 6 is inserted into the lamp fixing portion 99 and the insertion hole 98, and fixed to the lamp fixing portion 99. The reflector in a vehicle lamp 71 is constructed based on the position of the light-emitting unit 7 in the lamp 6 in this state.

The substantially whole light irradiated toward the main reflection surface 85 is reflected in the forward direction by the main reflection surface 85, as in the second embodiment. At this time, the first sub-reflector 83 and the second sub-reflector 84 are located ahead of the main reflection surface 85, but the first sub-reflector 83 is relieved outward of the main reflection surface 85 by the adjusting portion 88. Further, with respect to the second sub-reflector 84, the main reflector 81 itself is relieved outward of the second sub-reflector 84 by the relief portion 90. As a result, the light reflected by the main reflection surface 85 can be irradiated in the forward direction without being blocked.

The light reflected from the first sub-reflection surface 86, that is, the light in the range of from the front end irradiation light 58 to the intermediate irradiation light 59 is reflected by the first sub-reflection surface 86 toward the second sub-reflection surface 87, only in the portion where the first sub-reflection surface 86 is provided, and reflected in the forward direction by the second sub-reflection surface 87.

Further, the light-emitting unit 7*a* for driving is lighted so as to emit light. The light irradiated from the light-emitting unit 7*a* for driving is reflected by the main reflection surface 85 and the first sub-reflection surface 86, separately for each range. The light in the range of from the rear end irradiation light 60*a* for driving to the intermediate irradiation light 59*a* for driving is reflected in the forward direction by the main reflection surface 85. The light in the range of from the intermediate irradiation light 59*a* for driving to the front end irradiation light 58*a* for driving is reflected toward the second sub-reflection surface 87 by the first sub-reflection surface 86, and the light having reached the second sub-reflection surface 87 is reflected in the forward direction by the second sub-reflection surface 87.

In the vehicle lamp 71, the second sub-reflector 84 is provided with two reflection surfaces 87, with the reflection surface facing outward, respectively, and the front ends 87*b* of the second sub-reflection surfaces 87 are closest to each other at the front end 84*b* of the second sub-reflector 84. As a result, the portion where the second sub-reflection surfaces 87 are closest to each other forms a sharp shape. Further, the second sub-reflector 84 is located substantially at the center of the main reflector 81 and the first sub-reflector 83, and located ahead of the lamp to cover the lamp 6. As a result, a novel design can be obtained, since the sharp shape of the second sub-reflector 84 covering the lamp 6 is visually remarkable. Further, in the vehicle lamp 71, the design effect can be improved by applying aluminum evaporation or silver plating on the front face (a face opposite to the lamp lens 3) of the second sub-reflector 84, so as to provide the second sub-reflection surface 87.

In the vehicle lamp 71, the whole light in the range of from the intermediate irradiation light 59 to the rear end irradiation light 60, of the irradiation light irradiated from the lamp 6, is reflected in the forward direction, but the light in the range of from the front end irradiation light 58 to the intermediate irradiation light 59 is reflected in the forward direction, only in the portion where the sub-reflector formed by the first sub-reflector 83 and the second sub-reflector 84 is provided. In the vehicle lamp 71, when compared with the conventional vehicle lamp, not only the size of the reflector becomes small, but also a size in a predetermined direction can be decreased, since the sub-reflector exists partially. As a result, the size of the lamp lens 3 in a predetermined direction can be decreased, matched with the shape of the reflector.

As a result, according to the present invention, when the size is more important than the performance for illuminating forward, the size in a predetermined direction can be decreased, and essential performance for illuminating forward can be maintained, since the sub-reflector exists partially. Therefore, the degree of freedom in design of the vehicle can be further improved, by using the vehicle lamp 71 as the vehicle headlamp, thereby greatly improving the marketing value by design.

In the third embodiment, there are two sets of sub-reflectors formed by the first sub-reflector 83 and the second sub-reflector 84, but the number thereof may be more or may be only one. The range and the position thereof can be determined freely. In the third embodiment, the design can be determined freely, by changing the number, the position, and the range of the sub-reflector, according to the design of the vehicle.

With respect to the first sub-reflector 43 in the second embodiment, the position and the angle thereof can be changed by the adjusting portion 48. In the second embodiment, by changing these, the angle of the reflection light reflected by the first sub-reflector 43 is changed. In the second embodiment, therefore, the size of the second sub-reflector 44 also changes. In the second embodiment, when designing the reflector, the size of the first sub-reflector 43 and the second sub-reflector 44 can be changed by changing the adjusting portion 48, and a reflector having the optimum size can be obtained. The relation between the first sub-reflector 43, the second sub-reflector 44, and the adjusting portion 48 in the second embodiment is similar to the relation between the first sub-reflector 83, the second sub-reflector 84, and the adjusting portion 88 in the third embodiment.

In the first to the third embodiments, a halogen lamp has been explained, but the lamp may be an incandescent lamp or a discharge lamp, other than the halogen lamp. The present invention is not limited to the vehicle headlamp, and is applicable to any vehicle lamp, so long as a lamp and a reflector are used to irradiate light in one direction.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A vehicle lamp comprising:

a light source that emits light; and a reflector that reflects the light, wherein the reflector includes a main reflector and a first sub-reflector, formed in one, and a second sub-reflector separated from the main reflector and the first sub-reflector, the main reflector includes a main reflection surface that reflects one portion of the light in a forward direction, the first sub-reflector includes a first sub-reflection surface that reflects other portion of the light to the second sub-reflector without letting the other portion pass through the light source, the second sub-reflector includes a second sub-reflection surface that reflects the other portion reflected from the first sub-reflection surface in the forward direction, the first sub-reflector is arranged closer to an optical axis of the light than the main reflector is, inclined inward via a relief portion, so that the one portion reflected from the main reflection surface is not blocked, and the second sub-reflector is arranged ahead of the light source, so that the one portion reflected from the main reflection surface is not blocked, wherein, the light source includes a light-emitting unit that emits first light, the one portion is within a predetermined angle from a rear side among the first light, and the other portion is within a predetermined angle from a front side among the first light, wherein the light source further includes a second light-emitting unit that emits second light, the one portion is within a predetermined angle from a rear side among the first light and the second light, and the other portion is within a predetermined angle from a front side among the first light and the second light.

2. The vehicle lamp according to claim 1, wherein the main reflection surface is formed of a partial surface of a paraboloid of revolution, having a main focal point, the first sub-reflection surface is formed of a curved surface obtained by rotating a part of an ellipse, having a first focal point and a second focal point, the second sub-reflection surface is formed of a curved surface obtained by rotating a part of a parabola, having a sub-focal point, the main focal point and the first focal point are located substantially at a same position, the second focal point and the sub-focal point are located at substantially a same position, the first light-emitting unit is located substantially at the main focal point and the first focal point, and the second light-emitting unit is located behind the main focal point and the first foal point.

3. The vehicle lamp according to claim 1, wherein the main reflection surface is formed of a partial surface of a paraboloid of revolution, having a main focal point, the first sub-reflection surface is formed of a curved surface obtained by rotating a part of an ellipse in a predetermined range, having a first focal point and a second focal point, the second sub-reflection surface is formed of a curved surface obtained by rotating a part of a parabola in a predetermined range, having a sub-focal point, the main focal point and the first focal point are located at substantially a same position, the second focal point and the sub-focal point are located at substantially a same position, and the light-emitting unit is located substantially at the main focal point and the first focal point.

4. The vehicle lamp according to claim 1, wherein the main reflection surface is formed of a partial surface of a paraboloid of revolution, having a main focal point, the first sub-reflection surface is formed of a curved surface obtained by rotating a part of an ellipse in a predetermined range, having a first focal point and a second focal point, the second sub-reflection surface is formed of a curved surface obtained by rotating a part of a parabola in a predetermined range, having a sub-focal point, the main focal point and the first focal point are located substantially at a same position, the second focal point and the sub-focal point are located at substantially a same position, the first light-emitting unit is located substantially at the main focal point and the first focal point, and the second light-emitting unit is located behind the main focal point and the first foal point.

5. A vehicle lamp comprising:

a light source that emits light; and a reflector that reflects the light, wherein the reflector includes a main reflector and a first sub-reflector, formed in one, and a second sub-reflector separated from the main reflector and the first sub-reflector, the main reflector includes a main reflection surface that reflects one portion of the light in a forward direction, the first sub-reflector includes a first sub-reflection surface that reflects other portion of the light to the second sub-reflector without letting the other portion pass through the light source, the second sub-reflector includes a second sub-reflection surface that reflects the other portion reflected from the first sub-reflection surface in the forward direction, the first sub-reflector is arranged closer to an optical axis of the light than the main reflector is, inclined inward via a relief portion, so that the one portion reflected from the main reflection surface is not blocked, and the second sub-reflector is arranged ahead of the light source, so that the one portion reflected from the main reflection surface is not blocked, wherein the second sub-reflector includes a plurality of the second sub-reflection surfaces, each of the second sub-reflection surfaces having a front edge, and the front edges substantially meet together at a front end of the second sub-reflector.

6. The vehicle lamp according to claim 5, wherein the second sub-reflector includes a front end and a rear end, and a shape of the second sub-reflector is narrowed from the rear end toward the front end, with the front end formed in a sharp apex.

7. A vehicle lamp comprising:

a light source that emits light; and a reflector that reflects the light, wherein the reflector includes a main reflector and a first sub-reflector, formed in one, and a second sub-reflector separated from the main reflector and the first sub-reflector, the main reflector includes a main reflection surface that reflects one portion of the light in a forward direction, the first sub-reflector includes a first sub-reflection surface that reflects other portion of the light to the second sub-reflector without letting the other portion pass through the light source, the second sub-reflector includes a second sub-reflection surface that reflects the other portion reflected from the first sub-reflection surface in the forward direction, the first sub-reflector is arranged closer to an optical axis of the light than the main reflector is, and arranged so that the one portion reflected from the main reflection surface is not blocked, and the second sub-reflector is arranged ahead of the light source, so that the one portion reflected from the main reflection surface is not blocked, wherein the second sub-reflector includes a plurality of the second sub-reflection surfaces, each of the second sub-reflection surfaces having a front edge, and the front edges substantially meet together at a front end of the second sub-reflector.

* * * * *